US008794169B2

(12) United States Patent
Harada et al.

(10) Patent No.: US 8,794,169 B2
(45) Date of Patent: Aug. 5, 2014

(54) POWER STEERING APPARATUS FOR SMALL VESSEL

(75) Inventors: Yoshihiro Harada, Wako (JP); Koichi Oka, Wako (JP); Masanobu Miyazaki, Tochigi (JP); Shinsuke Sekikawa, Tochigi (JP); Yoshimitsu Komuro, Tochigi (JP)

(73) Assignees: Honda Motor Co., Ltd., Tokyo (JP); Showa Corporation, Gyoda-shi (JP)

( * ) Notice: Subject to any disclaimer, the term of this patent is extended or adjusted under 35 U.S.C. 154(b) by 167 days.

(21) Appl. No.: 13/390,168

(22) PCT Filed: Aug. 25, 2010

(86) PCT No.: PCT/JP2010/064360

§ 371 (c)(1), (2), (4) Date: Feb. 13, 2012

(87) PCT Pub. No.: WO2011/040154

PCT Pub. Date: Apr. 7, 2011

(65) Prior Publication Data

US 2012/0137947 A1 Jun. 7, 2012

(30) Foreign Application Priority Data

Sep. 30, 2009 (JP) ..... 2009-228241
Sep. 30, 2009 (JP) ..... 2009-228242
Sep. 30, 2009 (JP) ..... 2009-228243

(51) Int. Cl.
*B63H 25/10* (2006.01)

(52) U.S. Cl.
USPC ..... 114/144 R; 440/53

(58) Field of Classification Search
USPC ..... 440/53; 114/144 R; 180/400, 412, 414, 180/415–417
See application file for complete search history.

(56) References Cited

U.S. PATENT DOCUMENTS 4,244,316 A * 1/1981 Kulischenko ..... 114/144 R
4,760,745 A * 8/1988 Garshelis ..... 73/862.333

(Continued)

FOREIGN PATENT DOCUMENTS

JP 63-252487 A 10/1988
JP 2-296594 A 12/1990

(Continued)

OTHER PUBLICATIONS

International Search Report of PCT/JP2010/064360, mailing date Dec. 7, 2010.

*Primary Examiner* — Lars A Olson
*Assistant Examiner* — Jovon Hayes
(74) *Attorney, Agent, or Firm* — Westerman, Hattori, Daniels & Adrian, LLP

(57) ABSTRACT

In a power steering apparatus for a small vessel, an electrically driven assist device (26) and a helm pump (27) formed of a swash plate type axial piston pump are arranged in parallel on a common base (28). The electrically driven assist device (26) and the helm pump 27 are connected through a transmission system (34) under the common base 28 and integrated into a steering oil pressure generating unit (6) functioning as the power steering apparatus. The electrically driven assist device (26) is carried on an instrument panel (3). The parallel arrangement of the electrically driven assist device (26) and the helm pump (27) allows the steering oil pressure generating device (6) to be reduced in vertical length, so that it is possible to shorten the distance between the instrument panel (3) and a bottom (2) of the vessel and to lower positions of a handle and an operator's seat, thereby realizing the low center of gravity.

16 Claims, 11 Drawing Sheets

(56) References Cited

U.S. PATENT DOCUMENTS

| | | | | | |
|---|---|---|---|---|---|
| 4,882,936 | A | * | 11/1989 | Garshelis | 73/862.333 |
| 4,896,544 | A | * | 1/1990 | Garshelis | 73/862.333 |
| 5,052,232 | A | * | 10/1991 | Garshelis | 73/862.336 |
| 5,961,358 | A | * | 10/1999 | Hardesty et al. | 440/75 |
| 2005/0181687 | A1 | * | 8/2005 | Okumura et al. | 440/53 |
| 2007/0197110 | A1 | * | 8/2007 | Takada et al. | 440/53 |
| 2008/0295613 | A1 | * | 12/2008 | Shimizu | 73/862.333 |
| 2012/0137947 | A1 | * | 6/2012 | Harada et al. | 114/146 |

FOREIGN PATENT DOCUMENTS

| | | | |
|---|---|---|---|
| JP | 4-317889 | A | 11/1992 |
| JP | 5-330488 | A | 12/1993 |
| JP | 2000-043794 | A | 2/2000 |
| JP | 2005-231383 | A | 9/2005 |
| JP | 2006-001508 | A | 1/2006 |
| JP | 2007-216911 | A | 8/2007 |
| JP | 2008-298534 | A | 12/2008 |

* cited by examiner

POWER STEERING APPARATUS FOR SMALL VESSEL

BACKGROUND OF THE INVENTION

1. Field of the Invention

The present invention relates to a power steering apparatus for a small vessel and more particularly to a power steering apparatus with an electrically driven assist device.

2. Description of the Related Art

For use in a small sized vessel such as a boat provided with a power propulsion unit such as an outboard engine or the like, there is publicly known the art that a power steering apparatus is employed in a steering system. As an example of this known art, a steering system comprises a handle being pivotally supported on an instrument panel on which a meter and the like for a cabin are mounted, a power steering apparatus and an oil hydraulic pump device being mounted in series with each other on a steering shaft of the handle, in which the hydraulic pump device is driven by an assist output power to generate oil pressure such that an outboard engine is rotated by this oil pressure for steering the boat (see a patent reference 1).

This power steering apparatus is an electrically driven assist device which comprises a worm gear being operated by an electric motor, and a worm wheel being engaged with the worm gear to rotate the steering shaft. In the electrically driven assist device, a torque sensor detects a steering torque manually applied to the handle. Based on the detected values, the electric motor is controlled to exert a proper assist torque. The oil hydraulic pump device is a helm pump which is comprised of a swash plate type axial piston pump and which is configured to generate the oil pressure in proportion to the output power of the electrically driven assist device.

Moreover, there is known the art that a handle is provided with a tilt mechanism which makes it possible to adjust a tilt angle relative to an instrument panel and that an oil hydraulic pump device is carried on the instrument panel (see a patent reference 2).

Patent reference 1: Japanese patent laid-open publication No. JP 2005-231383A.

Patent reference 2: Japanese patent laid-open publication No. JP 2000-43794A.

By the way, the above electrically driven assist device is integrally mounted in series with the oil hydraulic pump device with respect to the steering shaft of the handle. Therefore, the power steering apparatus extends long under the instrument panel so that the distance between a bottom of the boat and the instrument panel increases to thereby position the center of gravity of an operator higher. However, it is desirable that the boat which pitches and rolls by catching the waves has the lower center of gravity to stabilize a hull. This requires the length of the power steering apparatus to be shortened and the space of the arrangement of the apparatus under the instrument panel to be decreased, in such a way as to lower the positions of the handle and the operator's seat, so that the center of gravity is lowered.

Further, in the above mentioned power steering apparatus, since the electrically driven assist device and the oil hydraulic pump device are integrally connected in series with each other, the driving force of the electrically driven assist device is transmitted at a ratio of one to one to the oil hydraulic pump device. However, in order to steer clear of complicated waves, it is desirable to provide the steering performance of good response, namely, the effective steering function. For that reason, it is required to enhance the pumping efficiency of the oil hydraulic pump device thereby to improve the steering response.

Furthermore, the torque sensor in the above mentioned patent reference 1 comprises a torque ring adapted to move in an axial direction in response to the steering torque along an input shaft which is connected to the steering shaft, a torque pin projecting from the torque ring, and a detecting element of the torque sensor on which the torque pin slides. When the torque pin slides on the detecting element of the torque sensor, the steering torque is detected from the position of the torque pin. Thus, since the torque pin keeps in direct contact with the detecting element of the torque sensor, the impact against the steering shaft is easily transmitted to the detecting element of the torque sensor. The torque sensor, however, is a precision device. Therefore, when an impact load is imposed on the detecting element of the torque sensor, an error of the detected value increases so as to make it difficult to perform the accurate assist. Moreover, the torque sensor for use in the small vessel such as the boat is in such an environment as to easily take a large impact by the waves or the like. Accordingly, it is desirable to improve the detecting accuracy of the torque sensor even in such environment.

It is, therefore, an object of the present invention to provide the art for shortening the length of a power steering apparatus. Herein, the length of the power steering apparatus means the length in the direction of a rotation shaft of an electrically driven assist device.

Another object of the present invention is to provide a power steering apparatus capable of enhancing the pumping efficiency of an oil hydraulic pump device so as to improve the steering response.

A further object of the present invention is to provide a power steering apparatus capable of improving the detecting accuracy of a torque sensor.

SUMMARY OF THE INVENTION

According to a first aspect of the present invention, there is provided a power steering apparatus for a small vessel comprising a steering means being arranged on a rear part of a hull to be rotatable in a horizontal direction, a pump device adapted to generate oil pressure through operation of a handle in a cabin to hydraulically drive the steering means, and an electrically driven assist device for applying assist force to steering torque generated through the operation of the handle, wherein the pump device and the electrically driven assist device are arranged in parallel on a common base and formed into an integrated unit such that rotation output power which is outputted from an output shaft functioning as a rotation shaft of the electrically driven assist device is transmitted through a transmission system to a driving shaft of the pump device.

According to a second aspect of the present invention, the integrated unit is disposed within a space defined under an instrument panel on which the handle is supported, and the electrically driven assist device is carried on the instrument panel.

According to a third aspect of the present invention, the pump device and the electrically driven assist device are mounted on the common base, while the transmission system is disposed under the common base.

According to a fourth aspect of the present invention, the pump device comprises a pump shaft functioning as a rotation shaft to be rotated by driving torque which is transmitted through the transmission system, and the pump shaft is arranged in parallel with the output shaft of the electrically driven assist device.

According to a fifth aspect of the present invention, the electrically driven assist device comprises an electric motor, a worm gear being driven by the electric motor, a worm wheel being engaged with the worm gear, and the output shaft being coaxially and integrally combined with the worm wheel, wherein the electric motor and the pump device are arranged on the right and left of the output shaft.

According to a sixth aspect of the present invention, a periphery of the transmission system is covered with a transmission cover.

According to a seventh aspect of the present invention, there is provided a power steering apparatus for a small vessel comprising a steering means being arranged on a rear part of a hull to be rotatable in a horizontal direction, a pump device adapted to generate oil pressure through operation of a handle in a cabin to hydraulically drive the steering means, and an electrically driven assist device for adding assist force to steering torque generated by the operation of the handle, wherein the pump device and the electrically driven assist device are arranged in parallel on a common base such that rotation output power outputted from an output shaft of the electrically driven assist device is transmitted through a transmission system to a driving shaft of the pump device, wherein the pump device comprises a swash plate type axial piston pump, and wherein the transmission system transmits the rotation output power of the electrically driven assist device at increasing speed to the pump device.

According to an eighth aspect of the present invention, the transmission system comprises a gear train.

According to a ninth aspect of the present invention, the transmission system comprises a pair of sprockets, and a chain being wrapped around the pair of sprockets to function as a transmission means.

According to a tenth aspect of the present invention, the transmission system comprises a pair of pulleys, and an endless belt being wrapped around the pair of sprockets to function as a transmission means.

According to an eleventh aspect of the present invention, a speed change mechanism which makes a speed change ratio variable is provided in the transmission system.

According to a twelfth aspect of the present invention, there is provided a power steering apparatus for a small vessel comprising a steering means being arranged on a rear part of a hull to be rotatable in a horizontal direction, a pump device adapted to generate oil pressure through operation of a handle in a cabin to hydraulically drive the steering means, a torque sensor adapted to detect steering torque which is generated through the operation of the handle, and an electrically driven assist device adapted to generate assist force based on the torque detected by the torque sensor, wherein the pump device and the electrically driven assist device are arranged in parallel on a common base such that rotation output power outputted from an output shaft of the electrically driven assist device is transmitted through a transmission system to a driving shaft of the pump device, and wherein an input shaft of the electrically driven assist device is connected to a steering shaft of the handle and the torque sensor is arranged around the input shaft such that an impact load in an axial direction which is transmitted from the handle to the input shaft is not directly imposed on a detection element of the torque sensor.

According to a thirteenth aspect of the present invention, the torque sensor is adapted to magnetometrically detect torsion between the input shaft and an output shaft of the electrically driven assist device.

According to a fourteenth aspect of the present invention, the torque sensor is arranged through a bearing around the input shaft and fixed to the electrically driven assist device.

According to a fifteenth aspect of the present invention, the electrically driven assist device is carried through a tubular holder on an instrument panel, and the torque sensor is arranged within the holder.

According to a sixteenth aspect of the present invention, each of the input shaft and the output shaft of the electrically driven assist device extends coaxially and is supported through a bearing on a gear case of the electrically driven assist device, and the bearing of the torque sensor is located above the bearing of the input shaft.

Effects of the Invention

According to the first aspect of the present invention, the pump device and the electrically driven assist device are arranged in parallel with each other on the common base and formed into the integrated unit, so that steering force transmission route of the power steering apparatus is turned by the transmission system. Therefore, in comparison with the case where the electrically driven assist device and the oil hydraulic pump device are arranged in series and formed into one integrated unit in the axial direction such that each of the rotation shafts thereof extends coaxially, the power steering apparatus may be reduced in length and limited to the length of any longer one of the rotation shafts of the electrically driven assist device and the pump device. Thus, when the power steering apparatus is mounted on the hull of the small vessel which has a limited arrangement space in an upward and downward direction, the freedom of arrangement of the power steering apparatus may be enhanced. Moreover, it is possible to have the pump device arranged in the optimum posture in performance.

According to the second aspect of the present invention, since the length of the power steering apparatus is reduced by having the pump device and the electrically driven assist device arranged in parallel, the pump device and the electrically driven assist device may be disposed under the instrument panel. Also, since these devices are integrally combined into one unit as a whole, the whole of the unit may be carried on the instrument panel by having the electrically driven assist device carried on the instrument panel. Further, since the height of the unit is able to be lowered, the distance between the bottom of the vessel and the instrument panel is capable of being decreased, so that the position of the handle may be lowered. Therefore, the operator's seat is lowered to thereby realize the lower center of gravity, so that the center of gravity of the hull of the boat which pitches and rolls by catching the waves may be lowered to stabilize the hull. Furthermore, since the length of the power steering apparatus is shortened, the power steering apparatus can be arranged at a high degree of freedom within the space under the instrument panel that has many limitations in size.

According to the third aspect of the present invention, since the pump device and the electrically driven assist device are mounted on the common base while the transmission system is disposed under the common base, the upper and lower spaces of the common base can be partitioned by function through the use of the common base, whereby the transmission system can be efficiently accommodated in the lower space.

According to the fourth aspect of the present invention, since the pump shaft is arranged in parallel with the output shaft of the electrically driven assist device, the transmission system connecting each of the pump shaft and the output shaft can be made simple in construction.

According to the fifth aspect of the present invention, the electric motor and the pump device are arranged on the right and left of the output shaft of the electrically driven assist device. Therefore, when the electrically driven assist device is carried on the instrument panel above the output shaft, it is easy to balance a weight between left and right, so that the power steering apparatus may be suspended from and carried on the instrument panel in a stable condition.

According to the sixth aspect of the present invention, since the periphery of the transmission system is covered with the transmission cover, the transmission system is able to be prevented from exposure through the provision of the transmission cover, to thereby allow the transmission system to establish connection between the electrically driven assist device and the pump device. Moreover, when a lower part of the transmission cover is opened, it is possible to provide effective waterproof and dustproof capabilities against water and dust from above, while improving cooling efficiency of the rotating section.

According to the seventh aspect of the present invention, since the rotation output power of the electrically driven assist device is transmitted at increasing speed through the transmission system to the driving shaft of the pump device, a number of the pressure oil discharge per unit time of the axial piston can be increased so as to enhance the pump efficiency. For this reason, even if the pump device is formed as the axial piston pump, the operation of the steering means is quickened so as to enable the steering of good response to be performed. Thus, the power steering apparatus is fit for the steering apparatus for the vessel that requires frequent and quick steering.

According to the eighth aspect of the present invention, since the transmission system comprises the gear train, the steering torque can be accurately and promptly transmitted to the pump device. Moreover, when the transmission system is configured in the form of a chain driven type as defined in the ninth aspect of the present invention or in the form of a belt driven type as defined in the tenth aspect of the present invention, a low cost transmission system can be obtained. Further, it is easy to vary the distance between the output shaft of the electrically driven assist device and the pump shaft of the pump device, so that the freedom of layout of the electrically driven assist device and the pump device may be enhanced. Furthermore, when the speed change mechanism is provided as defined in the eleventh aspect of the present invention, the transmission ratio of the steering torque can be made variable extensively. In addition, the transmission ratio can be made freely adjustable such that the response which meets the operator's tastes is obtained, so as to realize comfortable traveling.

According to the twelfth aspect of the present invention, the input shaft of the electrically driven assist device is connected to the steering shaft of the handle and the torque sensor is arranged around the input shaft such that the impact load in the axial direction which is applied from the handle to the input shaft is not directly imposed on the detection element of the torque sensor. Therefore, even when the impact load in the axial direction is applied through the handle to the input shaft, the impact load comes out in the axial direction of the input shaft and is not directly imposed on the detection element of the torque sensor, so that it is possible to keep the torque sensor out of influence due to the impact load thereby enabling the detection accuracy of the torque sensor to be improved.

According to the thirteenth aspect of the present invention, since the torque sensor magnetically detects the torsion between the input shaft and the output shaft of the electrically driven assist device through the steering torque, it is possible to configure the arrangement such that the application of the impact load between the detection element of the torque sensor and the input shaft is restricted.

According to the fourteenth aspect of the present invention, since the torque sensor is arranged through the intermediary of the bearing around the input shaft and fixed to the electrically driven assist device, the torque sensor establishes indirect contact with the input shaft, whereby the impact load of the input shaft is not directly applied to the detection element of the torque sensor. Moreover, since the torque sensor is fixed on the electrically driven assist device on which the input shaft is carried, it is possible to fix the positional relation between the detection element of the torque sensor and the input shaft.

According to the fifteenth aspect of the present invention, since the torque sensor is arranged within the tubular holder which has the electrically driven assist device carried on the instrument panel, it is possible to guard the torque sensor by the holder.

According to the sixteenth aspect of the present invention, each of the input shaft and the output shaft of the electrically driven assist device extends coaxially and is supported through the intermediary of the bearing on the gear case of the electrically driven assist device, and the bearing of the torque sensor is located above the bearing of the input shaft. Therefore, the detection element of the torque sensor can be arranged in the minimum deflection region of the input shaft.

DETAILED DESCRIPTION OF THE PREFERRED EMBODIMENT

Figure 1:
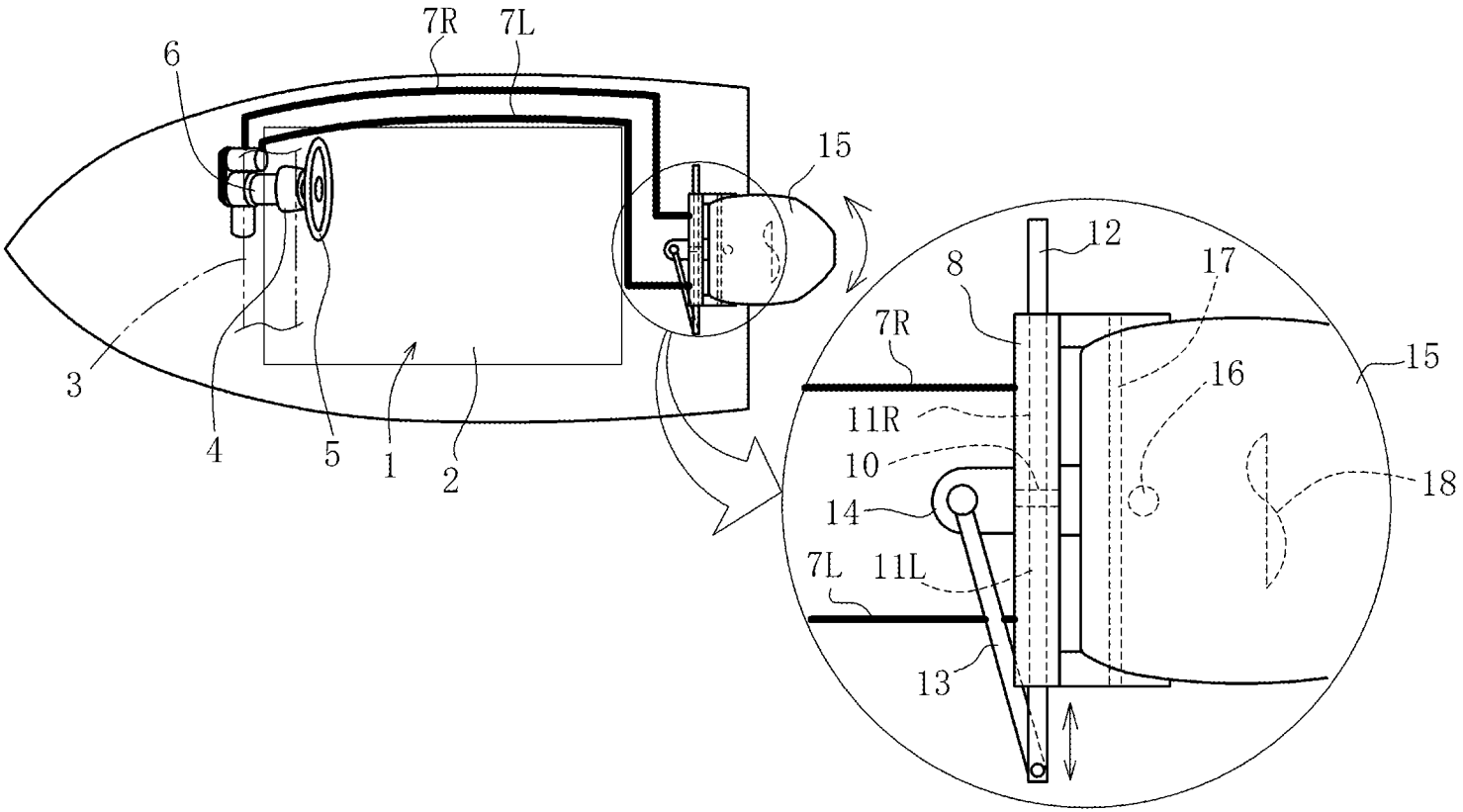
FIG. 1 is a schematic plan view of a small boat with a power unit to which the present invention is applied.

An embodiment of the present invention will be described with reference to the accompanying drawings. FIG. 1 is a plan view of a small boat with a power unit to which the present invention is applied. In the following description, the expression such as front and rear, left and right, and up and down is used on the basis of a condition that the boat moves forward, wherein a traveling direction means a forward direction, and a left and right means the left and right in the traveling direction.

In the middle of a hull of the boat, there is provided a cabin 1 the bottom of which is formed as a bottom 2 of the boat. In a front part of the cabin 1 is provided an instrument panel 3 on which a handle 5 is rotatably supported in such a condition that a tilt angle is adjustable through a tilt mechanism 4. The handle 5 is a steering wheel in the shape of a ring. An operator's seat is provided in the vicinity of and on the rear side of the handle 5 and the instrument panel 3, and in a forward right side position of the cabin 1. The handle 5 is located in a relatively low position. As a result, the operator's seat is also located in a low position so as to lower the center of gravity.

A steering shaft (as will be described later) of the handle 5 is connected to a steering oil pressure generating unit 6 which is configured as a power steering device, so as to generate oil pressure in proportion to a rotation amount of the handle 5. A piping 7R for rightward steering and a piping 7L for leftward steering each extend from the steering oil pressure generating unit 6 in such a manner that the oil pressure from the steering oil pressure generating unit 6 is supplied to either of the rightward steering piping 7R or the leftward steering piping 7L in response to the rotation direction of the handle 5.

Each of the rear ends of the rightward steering piping 7R and the leftward steering piping 7L is connected to a steering cylinder 8 which is located at a rear end of the hull. The steering cylinder 8 is partitioned by a piston 10 into a right chamber 11R and a left chamber 11L. The rightward steering piping 7R is connected to the right chamber 11R while the leftward steering piping 7L is connected to the left chamber 11L.

The piston 10 is integrally connected with a piston rod 12 which passes through the steering cylinder 8 in an axial direction thereof in such a manner as to be movable in advancing and retreating directions. One end of a link 13 is joined to an end of the piston rod 12 projecting from an end of the steering cylinder 8 while the other end of the link 13 is joined to a front end of a steering arm 14. A rear end of the steering arm 14 is integrally combined with an outboard engine 15.

The outboard engine 15 is a publicly known steering means in which an engine is installed. The outboard engine 15 is capable of swinging in a horizontal direction around a vertical swivel shaft 16 and capable of swinging in an upward and downward direction around a horizontal shaft 17. A reference character 8 denotes a propeller. However, the steering device in the present invention is not limited to the type of the outboard engine 15 like the above but may be formed as the one that is exclusively used for the steering.

When turning the handle 5 to the right, the oil pressure from the steering oil pressure generating unit 6 which is pressurized by the assist operation enters the right chamber 11R through the rightward steering piping 7R to thereby move the piston 10 leftward. An operation oil of the left chamber 11L which is decreased due to the movement of the piston 10 is returned through the leftward steering piping 7L to the steering oil pressure generating unit 6. At the same time, since the piston rod 12 moves in the leftward direction and the link 13 pulls a forward end side of the swing arm 14 to the left, the outboard engine 15 formed integral with the steering arm 14 rotates in a counter-clockwise direction around the swivel shaft 16 so as to steer and turn the boat in the rightward direction.

On the other hand, when steering the boat to the left, the operation opposite to the above is performed. Further, the steering oil pressure generating unit 6 is equipped with an electrically driven assist device. Therefore, when the handle 5 is rotated, the oil pressure by the steering oil pressure generating unit 6 is increased more than input power to the handle 5.

Figure 2:
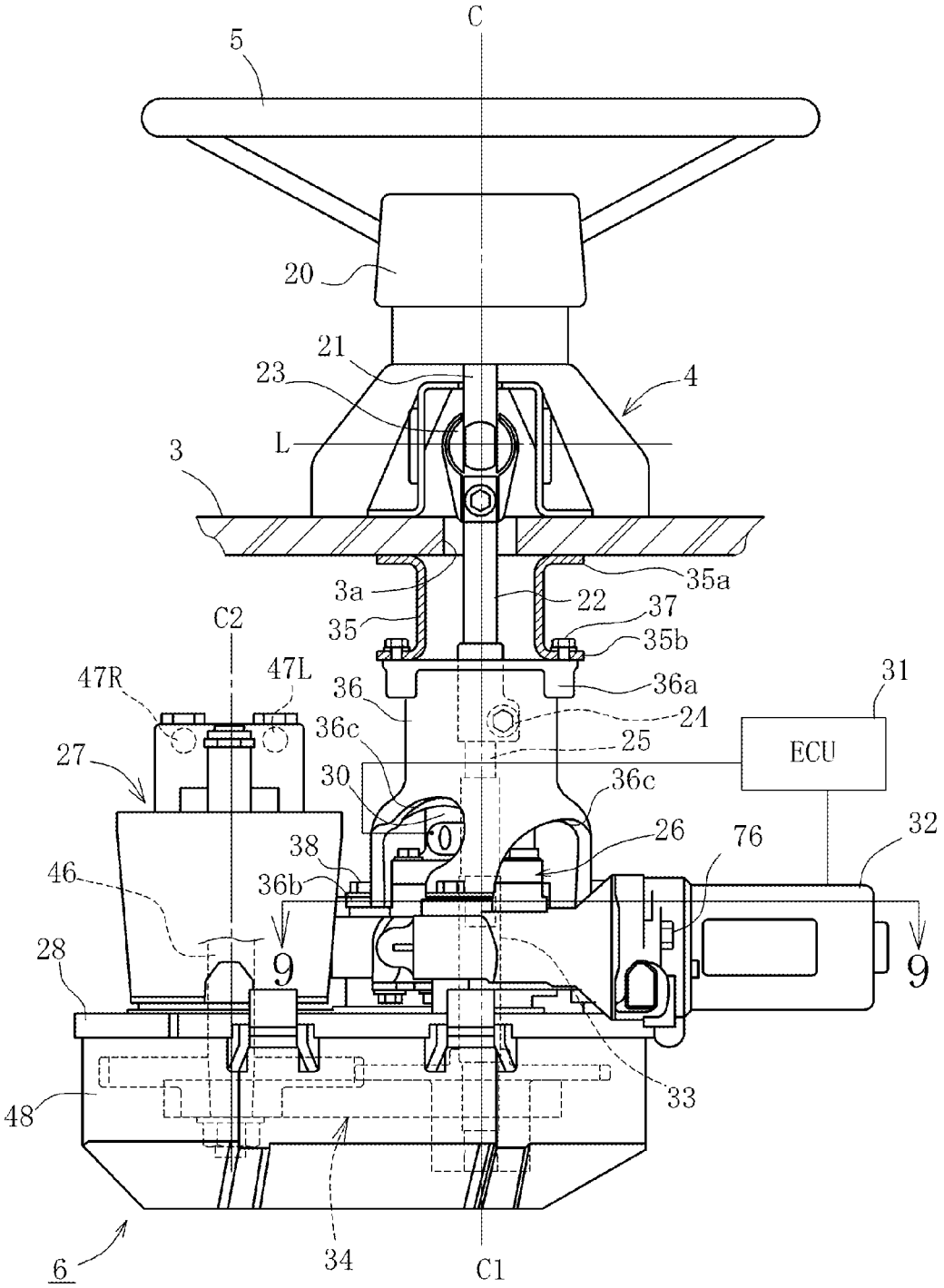
FIG. 2 is a view showing a mounting condition of a steering oil pressure generating unit to an instrument panel.

FIG. 2 is a partially sectional view showing a mounting condition of the steering oil pressure generating unit 6 on the instrument panel 3. The handle 5 has a boss 20 which is mounted through the tilt mechanism 4 on an upper wall of the instrument panel 3. A steering shaft 21 extends downwardly from the center of the handle 5. The tilt mechanism 4 is so configured by connecting the steering shaft 21 through a ball joint 23 to a joint shaft 22 which is connected to the steering oil pressure generating unit 6, that a center line C of the handle 5 is capable of being tilted in the direction of the front and back of the drawing around a horizontal axis L extending rightward and leftward in relation to the instrument panel 3. Thus, the tilt angle of the handle 5 in relation to the instrument panel 3 can be tilted according to what the operator wants.

The joint shaft 22 vertically passes through a through-hole 3*a* of the instrument panel 3. An upper end of the joint shaft 22 is connected to the ball joint 23, while a lower end thereof is connected through a joint 24 to an input shaft of the steering oil pressure generating unit 6. The steering oil pressure generating unit 6 is configured such that an electrically driven assist device 26 and a helm pump 27 are arranged in parallel and formed into one integrated unit on a common base 28. An input section of the electrically driven assist device 26 is provided with an input shaft 25. The helm pump 27 is comprised of a swash plate type axial piston pump.

The electrically driven assist device 26 is so configured that a torque sensor 30 which is arranged an upper part of the electrically driven assist device 26 detects manual steering torque of the handle 5 applied to the input shaft 25, that the detected manual steering torque is arithmetically computed by an ECU 31 to operate an electric motor 32 of the electrically driven assist device 26, and that a steering torque (hereinafter, simply referred to as steering torque) obtained by synthetically adding assist force to the manual steering torque is rotationally outputted to an output shaft 33. The input shaft 25 and the output shaft 33 each are rotation shafts of the electrically driven assist device 26.

The ECU 31 transmits the steering torque to the helm pump 27 through the intermediary of a transmission system 34 so as to generate a proper oil pressure from the helm pump 27. For example, it is provided with a control map on which the input torque and the assist force to be generated are related. Then, the proper assist force in response to the steering conditions is determined by looking up the control map to thereby command a driver 39 (FIG. 9) to operate the electric motor 32. By the way, in the case of a single axis type which is comprised of the single propeller 18, the boat has a tendency to making a turn to the rotational direction of the propeller 18. Accordingly, it is possible to be previously programmed to make a difference in the assist force between a right rotation and a left rotation.

The electrically driven assist device 26 is mounted and carried in a suspended fashion on the instrument panel 3 through the intermediary of an upper holder 35 and a lower holder 36 which are made of a rigid body such as metal and the like. The upper holder 35 is provided at the upper and lower ends thereof with flanges 35*a*, 35*b*. The upper end flange 35*a* is in contact with and mounted on a lower wall of the instrument panel 3. The lower end flange 35*b* is placed on a boss 36*a* which is located on an upper end of the lower holder 36 and which has nut portions, to thereby be fastened together by bolts 37 in the vertical direction. The height of the helm pump 27 is so determined that the upper end of the helm pump 27 is located in a lower position than the upper end of the lower holder 36 which is in a mounted condition on the electrically driven assist device 26. The helm pump 27 is arranged under the instrument panel 3 and allowed to be connected to the piping 7R for rightward steering and the piping 7L for leftward steering under the instrument panel 3.

The connecting portion between the upper holder 35 and the lower holder 36 which are formed in a tubular shape, respectively, is located in an overlapping position with the joint 24. The lower end of the lower holder 36 is fastened in a vertical direction on the upper wall of the electrically driven assist device 26 through bosses 36*b* thereof by bolts 38. Openings 36*c* are formed on plural portions of a lateral wall of the lower holder 36, so as to lighten the weight of the lower holder 36 and to make it possible to perform a harness connection to the torque sensor 30 provided inside. The opening 36*c* is also located in an overlapping position with the joint 24 (see FIG. 5) so as to allow the bolts of the joint 24 to be fastened and unfastened through the opening 36*c*.

Figure 3:
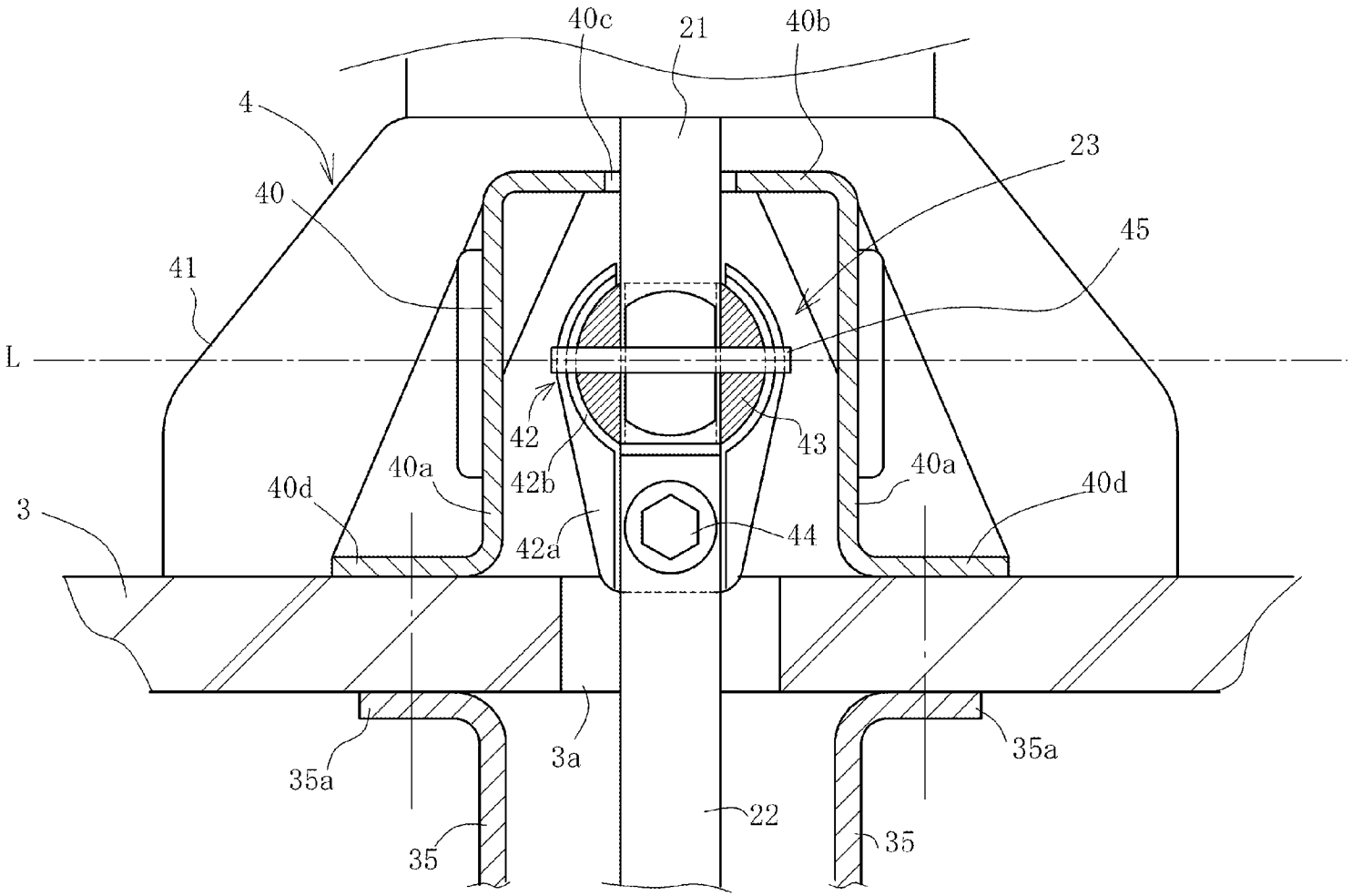
FIG. 3 is an enlarged cross sectional view of a tilt mechanism.

Next, the tilt mechanism 4 will be described in detail with reference to FIG. 3. The tilt mechanism 4 comprises a tilt frame 40, and a rubber boot 41 for covering the periphery of the tilt frame 40 to prevent dust and water. The tilt frame 40 comprises left and right lateral wall portions 40*a* extending in parallel with each other, and a top portion 40*b* connecting each of upper ends of a socket 42. On the top portion 40*b* is provided a long opening 40*c* through which the steering shaft 21 extends in an upward and downward direction. The long opening 40*c* is formed long in the direction of the front and back of the drawing so as to allow the steering shaft 21 to be tilted in the direction of the front and back of the drawing to adjust the tilt angle.

On each of lower ends of the tilt frame 40 are provided flanges 40*d* which are in contact with and fixedly secured through bolts and the like (not shown in the drawing) to the upper wall of the instrument panel 3. Then, the flange 35*a* of the upper holder 35 may be fastened together with the flange 40*d* on the instrument panel 3 in such a condition that the flange 35*a* comes into contact with the lower wall of the instrument panel 3 and that the flanges 40*d* and 35*a* are arranged on upper and lower positions of the instrument panel 3. In this case, the upper holder 35 and by extension the steering oil pressure generating unit 6 are configured to be suspended and carried through the instrument panel 3 by the tilt mechanism 4.

The ball joint 23 comprises the socket 42 and a ball 43. The socket 42 comprises a connecting section 42*a* which is engaged with the upper end of the joint shaft 22 and integrated by a bolt 44, and a spherical bearing section 42*b* on which the ball 43 is carried slidably. The ball 43 has a circumferential spherical section which is slidably carried on the spherical bearing section 42*b*. The lower end of the steering shaft 21 is engaged into a center section of the ball 43 and integrally connected together with the ball 43 and the socket 42 by a tilt shaft 45 which extends along a horizontal axis L intersecting at right angles to the center line C, so as to be rotatable together around the axis of the center line C. Moreover, the ball 43 and the steering shaft 21 are rotatable around the axis of the tilt shaft 45.

When a lock means (not shown in the drawing) for adjusting the tilt angle, which is provided between the steering shaft 21 and the tilt frame 40, is operated to an unlock position, the steering shaft 21 is able to be rotated around the axis of the tilt shaft 45. Therefore, the tilt angle of the steering shaft 21 is freely adjustable in such a way as to lock the steering shaft 21 at the preferred rotation angle by the lock means to thereby fix the rotational position thereof. By the way, the tilt mechanism 4 is not limited to the example shown in this embodiment, but various kinds of the conventional tilt mechanism may be employed.

Figure 4:
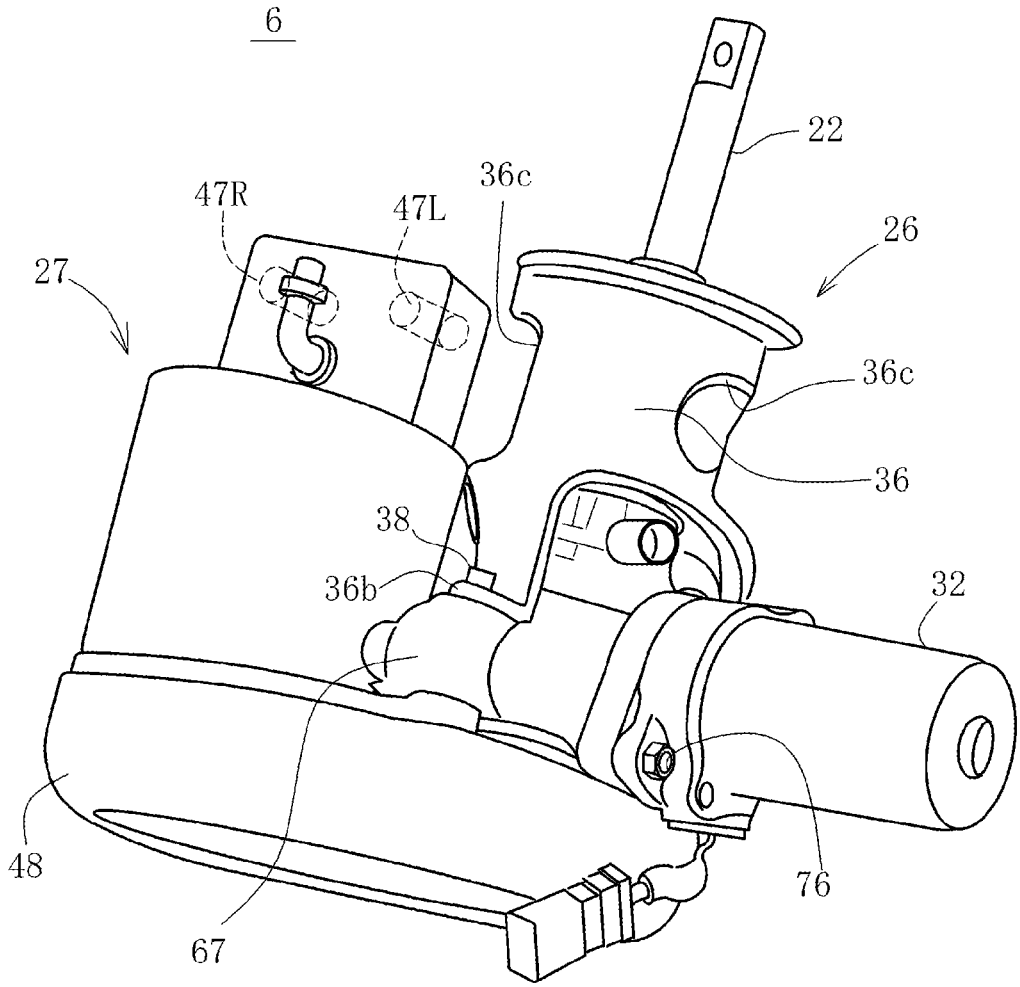
FIG. 4 is an external view in perspective of the steering oil pressure generating unit.
Figure 5:
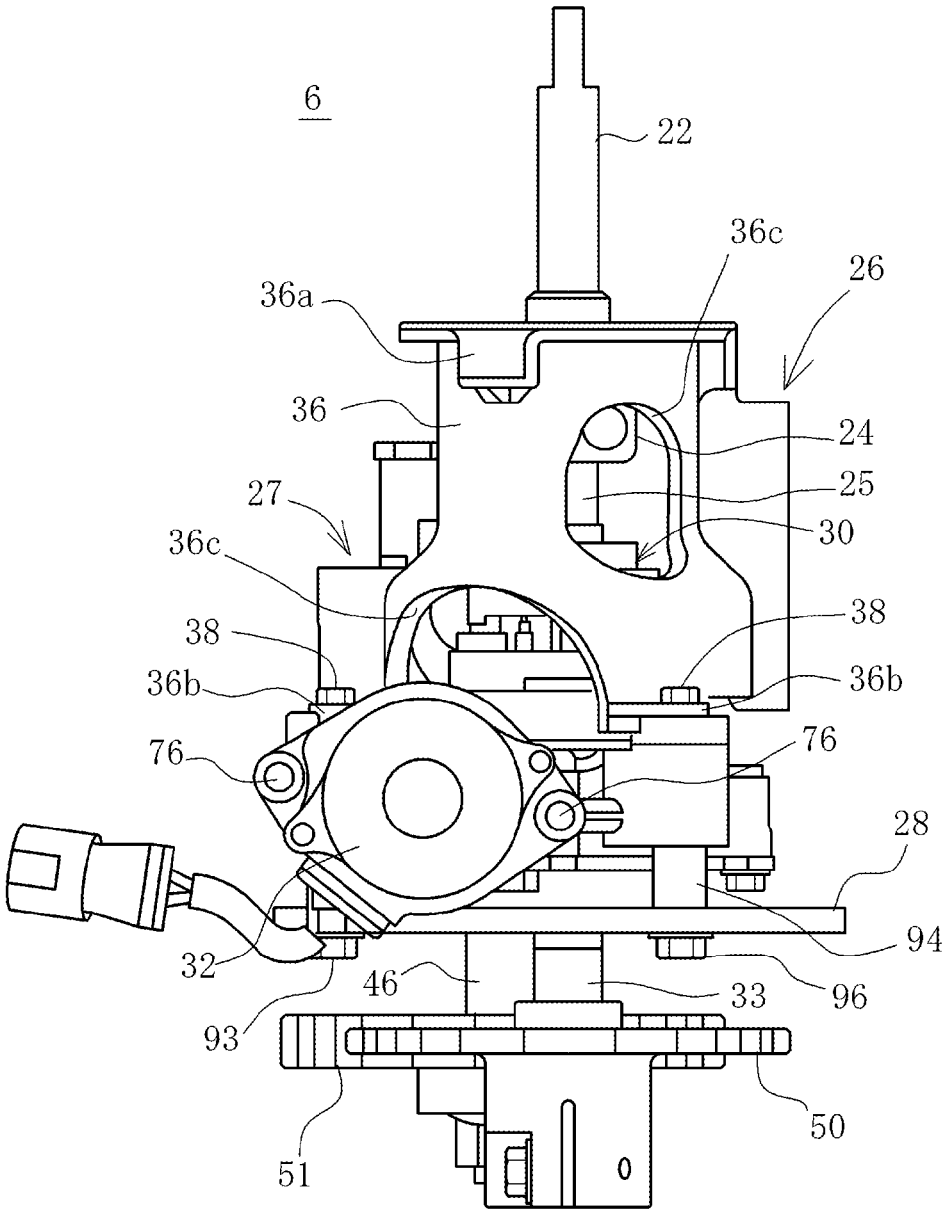
FIG. 5 is a side view of the steering oil pressure generating unit.
Figure 6:
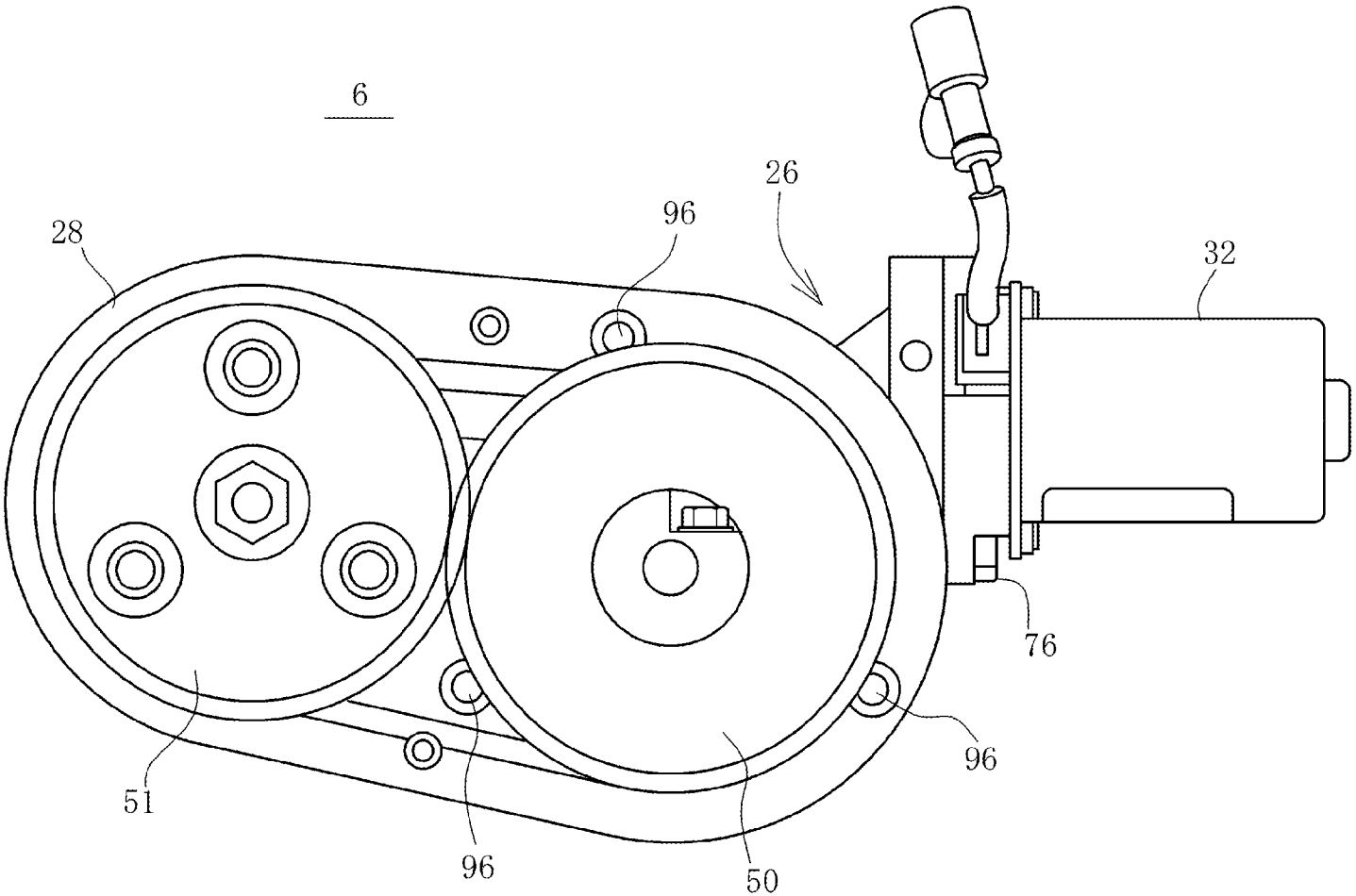
FIG. 6 is a bottom view of the steering oil pressure generating unit.
Figure 7:
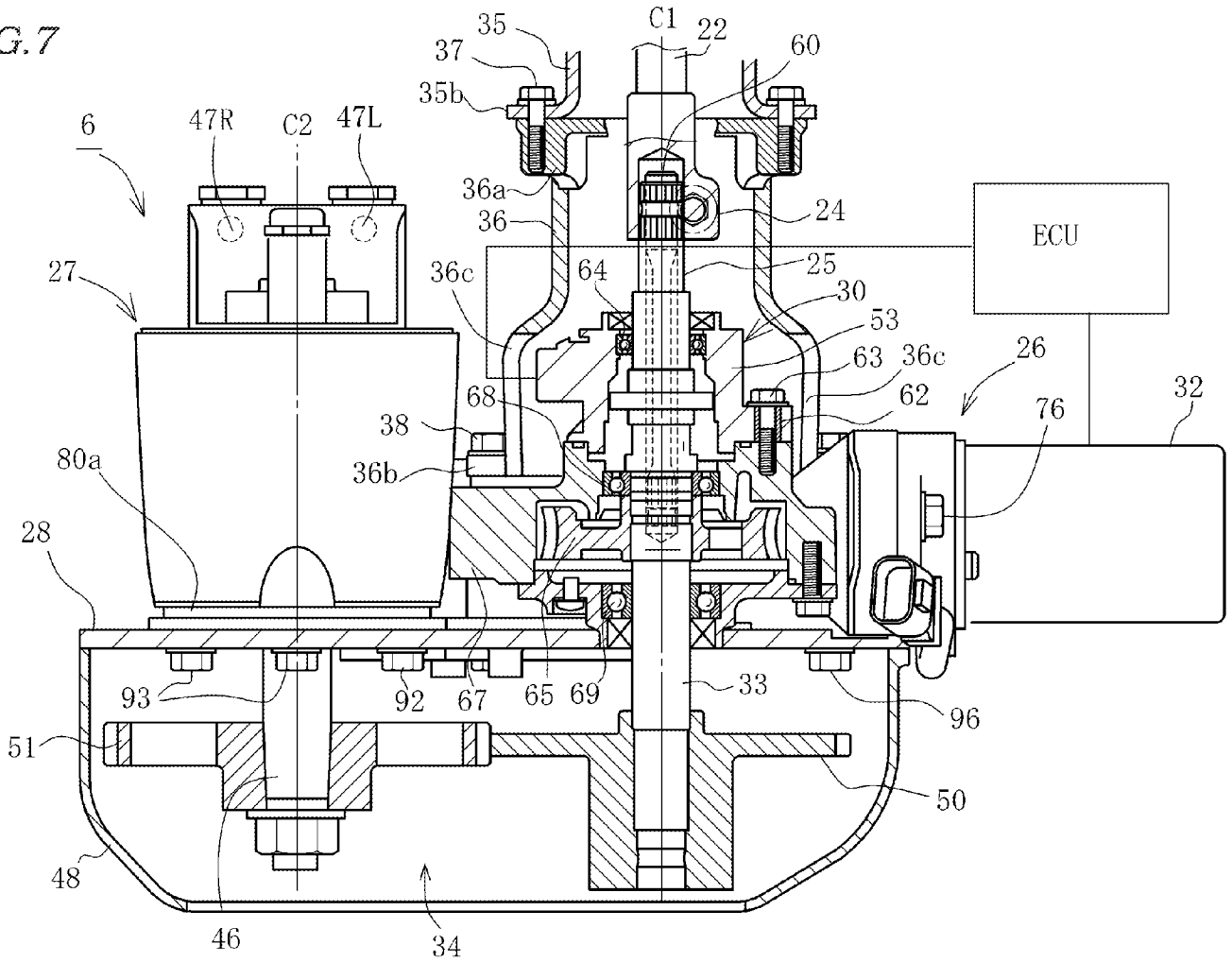
FIG. 7 is a longitudinal sectional view taken along center lines C1 and C2 of the steering oil pressure generating unit.
Figure 8:
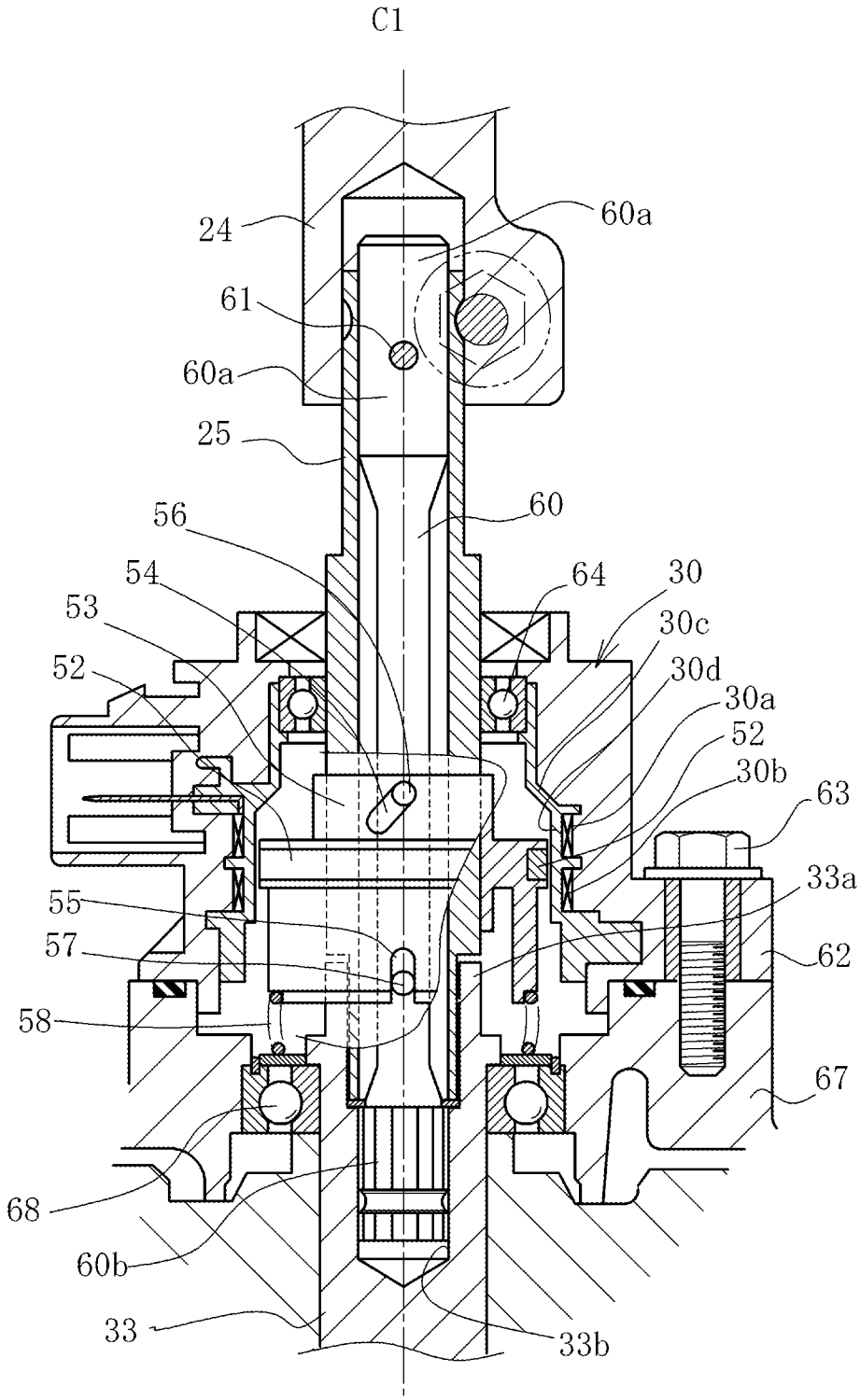
FIG. 8 is a partially enlarged sectional view of FIG. 7.

Next, the steering oil pressure generating unit 6 will be described in detail. FIG. 4 is an external view in perspective of the steering oil pressure generating unit 6. FIG. 5 is a side view thereof. FIG. 6 is a bottom view thereof. FIG. 7 is a longitudinal sectional view taken along the center line C. FIG. 8 is an enlarged view for describing a torque sensor section in detail. As clearly shown in FIGS. 4 and 7, the steering oil pressure generating unit 6 is constructed by allowing the electrically driven assist device 26 and the helm pump 27 to be placed side by side and by allowing them to be formed into one integrated unit in such a condition that the center axis C1 of the assist device which is the axis of the input shaft 25 and the center axis C2 of the pump device which is the axis of the pump shaft 46 corresponding to the rotation shaft of the helm pump 27 extend in parallel with each other. The steering torque is obtained such that the manual input torque of the handle 5 applied to the joint shaft 22 is increased in force by the assist force of the electrically driven assist device 26. The oil which has the oil pressure in proportion to the steering torque obtained as above is discharged from an outlet port 47R or an outlet port 47L provided in the upper region of the helm pump 27.

The outlet port 47R is coupled to the rightward steering piping 7R while the outlet port 47L is coupled to the leftward steering piping 7L (see FIG. 1). By the way, the pump shaft 46 extends in parallel with the output shaft 33. The output shaft 33 extends coaxial with respect to the input shaft 25 and the joint shaft 22. The assist device center axis C1 of the input shaft 25 and the output shaft 33 coincides with the center axis C of the handle 5.

A reference character 48 denotes a transmission cover in the shape of a skirt which surrounds the transmission system 34 and is made of a proper material such as metal, resin or the like. The transmission cover 48 is attached through the upper portion thereof to the common base 28 and is opened downward (the transmission cover 48 is omitted in FIG. 5 and FIG. 6). The provision of the transmission cover 48 allows the transmission system 34 to be kept out of exposure, thereby enabling the electrically driven assist device 26 and the helm pump 27 to be connected by the transmission system 34.

Apparent from FIG. 6 and FIG. 7, the transmission system 34 in this embodied example is formed as a gear mechanism which has a drive gear 50 mounted on the output shaft 33 and a driven gear 51 mounted on the pump shaft 46. The drive gear 50 and the driven gear 51 are in engagement with each other. The speed change ratio (the number of teeth of the drive gear 50/the number of teeth of the driven gear 51) of this gear mechanism is larger than one, so that the rotation output power of the output shaft 33 is increased in speed to be transmitted to the pump shaft 46. By the way, the speed change ratio is freely determined when the speed increase at the speed change ratio larger than one is able to be obtained.

With the construction as above, the pump efficiency of the helm pump 27 is heightened thereby making it possible to improve the steering response. Namely, in the helm pump 27, the pump efficiency is heightened with increasing the number of pressure oil discharge by an axial piston as referred to later. The number of pressure oil discharge by the axial piston is increased by accelerating the rotation of the pump shaft 46. Accordingly, when the steering torque outputted from the electrically driven assist device 26 is increased in speed and transmitted to the pump shaft 46, the rotation of the pump shaft 46 is accelerated to thereby enable the pump efficiency to be heightened. As a result, the steering operation of the outboard engine 15 which functions as the steering means is performed quickly to thereby make it possible to obtain the steering of good response. Thus, it is possible to obtain the steering means fit to the steering system for the small vessel which requires frequent and quick steering. Further, since the transmission system 34 is comprised of a gear train as the gear mechanism, the steering torque can be transmitted accurately and quickly to the pump device.

By the way, the gear mechanism of the transmission system 34 may be provided with an idle gear to meet the change in the center distance between axes while obtaining the compact construction. Moreover, the speed change ratio may be increased by the application of a multiple stage gear train. Further, the transmission system 34 is not limited to this kind of gear mechanism, but various kinds of publicly known transmission systems may be employed.

The electrically driven assist device 26 and the helm pump 27 are arranged in parallel on the common base 28. The transmission system 34 is arranged blow the common base 28. With the arrangement like this, the electrically driven assist device 26, the helm pump 27 and the transmission system 34 are able to be compactly integrated into one unit through the common base 28. Moreover, the rotation output power of the output shaft 33 is transmitted by the transmission system 34 to the pump shaft 46. Therefore, the freedom of layout of the helm pump 27 is enhanced. Also, the helm pump 27 of which an output device is influenced by the direction of arrangement can be arranged in a proper posture in view of performance. In addition, the pump shaft 46 and the output shaft 33 of the electrically driven assist device 26 are configured to extend in parallel, so that the transmission system 34 which connects each of the shafts 46 and 33 can be made simple in construction. Further, the electric motor 32 and the pump device 27 are arranged on the right and left sides of the output shaft 33 of the electrically driven assist device 26. With this construction, when the upper portion of the electrically driven assist device 26 is carried on the instrument panel 3 in the upward position of the output shaft 33 thereof, the weight on the right and left is easily balanced, so that the power steering apparatus can be stably carried on and suspended from the instrument panel 3.

The steering oil pressure generating unit 6 is configured by having the electrically driven assist device 26 and the helm pump 27 arranged in parallel on the common base 28 in such a way as to be combined into an integrated unit. Therefore, the length (the length in the direction of the center axis C1 of the assist device) of the steering oil pressure generating unit 6 is limited approximately to a total length of the electrically driven assist device 26 and the joint shaft 22. Thus, the length is shortened about one half of the length in the case of connecting in series the electrically driven assist device 26 and the helm pump 27. With this construction, the arrangement space under the instrument panel 3 can be made comparatively small, and the distance between the bottom 2 of the boat and the instrument panel 3 can be shortened. As a result, the arrangement with high degrees of freedom in the limited space under the instrument panel 3 is allowed and the low center of gravity is able to be obtained by making the operator's seat lower, so that it is easy to keep the boat stable when the boat rolls and pitches on the waves.

While the steering oil pressure generating unit 6 is shortened in the axial direction, it is widened in the width direction by the parallel arrangement of the electrically driven assist device 26 and the helm pump 27. However, under the instrument panel 3 there is comparatively enough room for the arrangement space in the right and left direction and in the front and rear direction other than the height direction. Therefore, the parallel arrangement allows the electrically driven assist device 26 and the helm pump 27 to be accommodated within this space. Thus, the freedom of layout can be enhanced. Moreover, since the steering oil pressure generating unit 6 is formed into one integrated unit as a whole, the entire unit can be carried when the electrically driven assist device 26 is carried through the upper holder 35 and the lower holder 36 on the instrument panel 3.

Next, the electrically driven assist device 26 will be described in detail with reference to FIG. 7, FIG. 8 which is a partially enlarged view of FIG. 7, and FIG. 9 which is a cross sectional view taken along line 9-9 of FIG. 2. As shown in FIG. 7 and FIG. 8, the input shaft 25 is a hollow shaft in an axial hole of which a torsion bar 60 is fitted in such a manner that the longitudinal axis thereof extends in the same direction with the axial direction of the hollow shaft. An upper end portion 60*a* of the torsion bar 60 is integrally connected through a pin 61 with an upper end portion of the input shaft 25. The upper end portion of the input shaft 25 is integrally connected through a serration with the joint 24 so as to be rotated together around the axis.

A lower end portion 60*b* of the torsion bar 60 is engaged into a dead-end shaped axial bore 33*b* formed in an upper end portion 33*a* of the output shaft 33 and connected integral with the upper end portion 33*a* through serration joining. The upper end portion 33*a* is fitted on an outer periphery of a lower end portion of the input shaft 25 so as to be relatively rotatable. Therefore, when the torque difference is generated between the manual steering force imposed on the handle 5 and the load of the output shaft 33 added from the helm pump 27, the input shaft 25 and the output shaft 33 rotate relatively thereby to allow the torsion bar 60 to be twisted. Then, this torsion amount is detected by the torque sensor 30, whereby the necessary torque can be detected.

On an outer periphery of the output shaft 33, a worm wheel 65 is mounted in such a way as to be rotatable together with the output shaft 33. The worm wheel 65 is engaged with a worm gear 66 (FIG. 9) which is driven by the electric motor 32. A gear case 67 for accommodating the worm wheel 65 and the worm gear 66 therein is carried through bearings 68, 69 on the outer periphery of the output shaft 33.

As shown in FIG. 8, the torque sensor 30 is comprised of a publicly known magnetic sensor that is positioned between the input shaft 25 and the output shaft 33 and that is fixedly mounted on an upper portion of the electrically driven assist device 26 through a boss 62 by a bolt 63. The torque sensor 30 is provided with two upper and lower coils 30*a*, 30*b* which function as a detecting element. The coils 30*a*, 30*b* each are wound in a circumferential direction around a bobbin 30*d* of a barrel portion 30*c* of the torque sensor 30 which surrounds the input shaft 25. On the inside of these coils 30*a*, 30*b*, a core 52 is arranged in the vicinity thereof and in an opposed relation thereto such that the voltage varies in accordance with the position of the core 52.

The core 52 is formed in annular shape and integrally fitted on an outer circumferential portion of a torque ring 53. The torque ring 53 is formed in the tubular shape and configured to be slidable and removable in the axial direction on the input shaft 25. On a circumferential wall of the torque ring 53 there are provided a spiral slot 54 and an axially extending vertical slot 55. Into the spiral slot 54 is engaged a torque pin 56 which is press-fitted integrally with the input shaft 25 and which projects outward in the radial direction. Into the vertical slot 55 is engaged a guide pin 57 which is press-fitted integrally with the upper end portion 33*a* of the output shaft 33 and which projects outward in the radial direction. Further, the torque ring 53 is spring-forced by a coil spring 58 in the upward direction. The torque pin 56 is positioned in the center of the spiral slot 54 in the neutral position thereof.

When the steering torque is applied from the handle 5 to the input shaft 25, the torque ring 53 tries to rotate around the input shaft 25 through the torque pin 56 combined integral with the input shaft 25. However, the rotation of the torque pin 53 is prevented by the guide pin 57 combined integral with the output shaft 33. The guide pin 57 is engaged with the vertical slot 55 in such a way as to allow the guide pin 57 and the torque pin 53 to perform the relative movement in the axial direction. Then, the torque ring 53 moves downward in the axial direction in opposition to the coil spring 58. The amount of this movement is in proportion to the torsion amount of the torsion bar 60. Therefore, the movement amount of the core 52 is detected through variations in voltage of the coils 30*a* and 30*b* and, then, converted into the torque amount. Thus, the steering torque is detected.

The torque sensor 30 is arranged on the outer periphery of the input shaft 25 through a bearing 64, so that it makes indirect contact with the input shaft 25. However, the coils 30*a* and 30*b* which function as the detection element are in non-contact with the core 52 and the torque ring 53. Therefore, the torque sensor 30 is so configured that the impact load applied in the axial direction of the input shaft 25 is released in the axial direction so as not to be directly imposed on the detection element of the torque sensor 30. Such configuration of the torque sensor 30 that the impact load applied in the axial direction to the input shaft 25 can be hardly directly transmitted to the detection element will be referred to as "non-contact".

As described above, the coils 30*a* and 30*b* functioning as the detection element of the torque sensor 30 is configured to be non-contact with the torque ring 53 of the input shaft 25. With this configuration, the large impact load being peculiar to the vessel, which is applied through the handle 5 to the input shaft 25, can be prevented from being directly transmitted to the detection element of the torque sensor 30, so that the detection error of the torque sensor 30 due to the impact load can be decreased as far as possible. Thus, the accurate assist amount can be determined. By the way, the torque sensor 30 is not necessarily limited to the one like this example. It is sufficient that the non-contact is kept between the detection element of the torque sensor 30 and the sides of the input shaft 25 and the output shaft 33, so publicly known type of magnetic sensor, optical sensor or the like can be properly employed.

The torque sensor 30 is carried through the bearing 64 on the outer periphery of the input shaft 25 by a portion other than the detection element portion. Besides, by fixedly mounting the torque sensor 30 on the electrically driven assist device 26 by which the input shaft 25 is supported, the positional relation between the torque sensor 30 and the input shaft 25 can be stably fixed. Moreover, the input shaft 25 and the output shaft 33 are coaxially positioned and each carried through the bearings 68 and 69 on the gear case 67 while the bearing 64 of the torque sensor 30 is positioned above the bearing 68 of the input shaft 25. With this construction, the torque sensor 30 can be arranged in the region of the minimum deflection of the input shaft 25. Further, since the torque sensor 30 is located within the tubular lower holder 36, the torque sensor 30 can be guarded by the lower holder 36.

Figure 9:
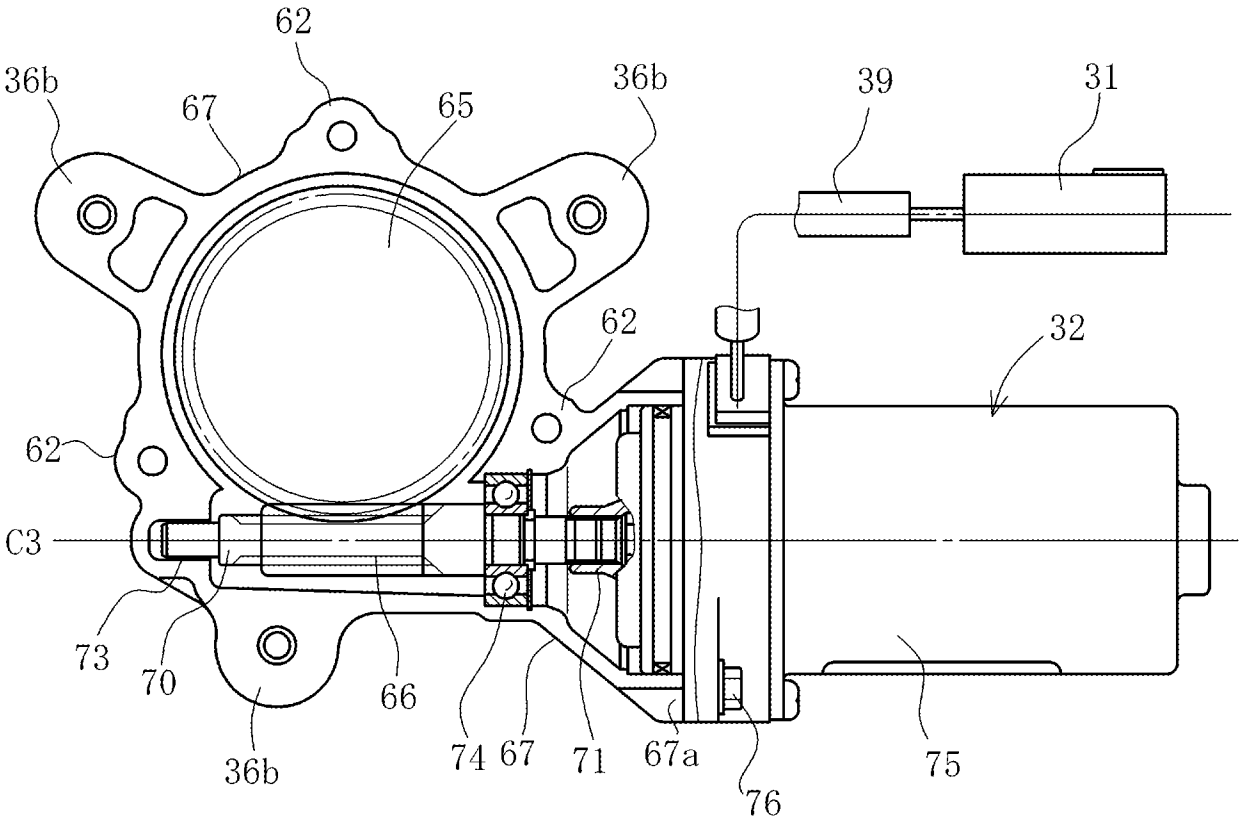
FIG. 9 is a sectional view taken on line 9-9 of FIG. 2.

As shown in FIG. 9, the worm gear 66 is formed on the worm shaft 70 which extends coaxial with a motor axis C3 lying at right angles to the assist center axis C1 of the electrically driven assist device 26. The worm shaft 70 extends coaxial with an output shaft 71 of the electric motor 32 and is carried on the gear case 67 by bearings 73, 74 on either side of the worm gear 66.

The electric motor 32 is provided with a motor case 75 which is removably mounted through a bolt 76 on a mounting section 67*a* formed on the gear case 67. By the way, on the gear case 67, the bosses 36*b* and the bosses 62 are provided at intervals of approximately 120°, respectively.

Figure 10:
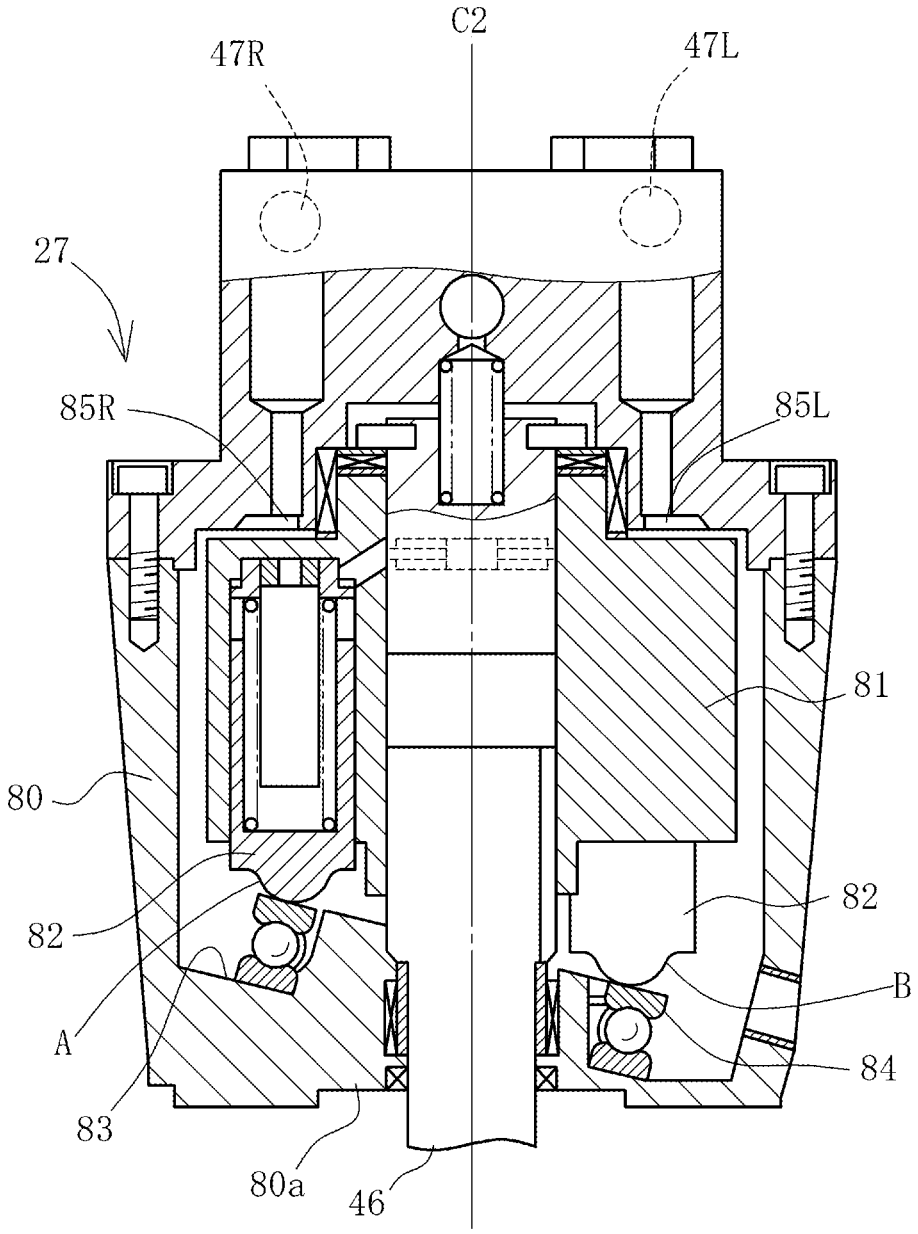
FIG. 10 is a longitudinal sectional view of a helm pump.

Next, the helm pump 27 will be described in detail with reference to FIG. 10. FIG. 10 corresponds to a cross sectional view taken along a plane which passes each neighborhood of the outlet port 47R and the outlet port 47L and which extends in parallel with the pump central axis C2. The pump shaft 46 extends in the vertical direction at the center of a pump case 80 of the helm pump 27 and projects downward by passing through a bottom portion 80*a*. Within the pump case 80, a rotor 81 is integrally mounted on an outer periphery of the pump shaft 46 so as to be rotatable together. Axial pistons 82 are spring-forced to project downward out of the rotor 81 and slidably contact the surface of a shoe 84 functioning as a bearing which is provided on a swash plate 83. The shoe 84 is tilted along the swash plate 83.

The plurality of axial pistons 82 are concentrically arranged at regular intervals around the pump shaft 46. When forward ends (lower ends) of the axial pistons 82 rotate together with the rotor 81 through the pump shaft 46 while slidably contacting the shoe 84, the axial pistons 82 move continuously between the highest position "A" where the axial piston 82 is pushed upward into the rotor 81 through the swash plate 83 and the lowest position "B" where the axial piston 82 projects downward out of the rotor 81. At the lowest position, the hydraulic oil is sucked, while at the highest position A, the hydraulic oil is compressed to thereby force the pressure oil out to an oil passage 85R or oil passage 85L. The oil passage 85R is connected to the outlet port 47R and the oil passage 85L is done to the outlet port 47L.

In the oil passages 85R and 85L there are provided check valves (not shown in the drawing) for checking oil return. When the rotor 81 is rotated in a clockwise or counterclockwise direction by the handle operation, the check valve provided in one of the oil passages 85R and 85L corresponding to the rotational direction is opened by the pressure oil pressurized by the axial piston 82, thereby allowing the oil to be discharged from the outlet port 47R or 47L connected thereto. At the same time, a portion of the pressurized oil opens another check valve provided in the other of the oil passages 85R and 85L, thereby making it possible to suck the return oil. For example, when the pressure oil is discharged out of the outlet port 47R, another outlet port 47L functions substantially as an inlet port to suck the return oil forced out of the cylinder 8 thus to return the oil from the oil passage 85L into the pump.

By the way, while the above described type of helm pump 27 is publicly known as a manual input type oil hydraulic pump device, the hydraulic pump device is not limited to this type, but it is possible to employ various types of publicly known hydraulic pumps.

Figure 11:
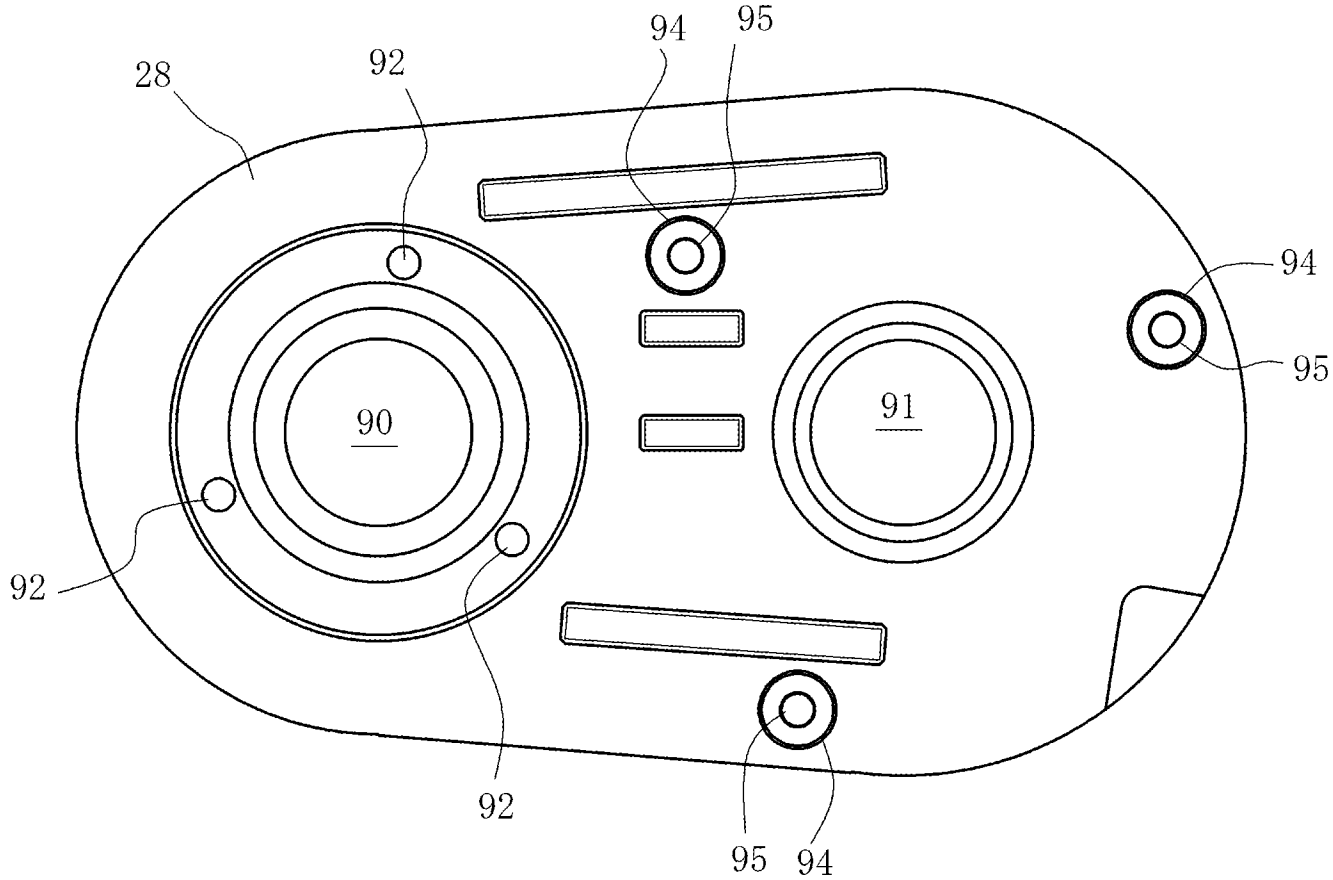
FIG. 11 is a plan view of a common base.

Next, the common base 28 will be described in detail. FIG. 11 is a plan view of the common base 28. The common base 28 is made of metal and formed in a substantially oval shape. In the direction of longitudinal axis there are provided a shaft hole 90 for the helm pump 27 and a shaft hole 91 for the output shaft 33.

Around the shaft hole 90 are concyclically formed through-bores 92 through which bolts 93 (FIG. 7) are inserted from the underside of the common base 28 to thereby be fastened to a bottom portion 80*a* of the pump case 80 positioned on the through bores 92. Thus, the helm pump 27 is fixedly mounted on the common base 28. By the way, when the through bores 92 are formed in the shape of a crescent or radial slot, it allows various kinds of helm pumps 27 which have different mounting positions, to be mounted on the same common base 28.

Bosses 94 are formed on one and the same circle at regular intervals around the shaft holes 91. On the bosses 94 the gear case 67 is positioned. When bolts 96 are inserted from the lower side into through-bores 95 of the bosses 94 and each of distal end sides of the bolts 96 is fastened to each of nut portions previously provided on the bottom of the gear case 67, the electrically driven assist device 26 is fixedly mounted on the common base 28. By the way, when a large number of bosses 94 are previously provided at regular intervals in the circumferential direction or at different distances in the radial direction, it allows various kinds of electrically driven assist devices 26 which have different mounting positions, to be amounted on the same common base 20.

Like this, the electrically driven assist device 26 and the helm pump 27 are mounted in a removable manner on the common base 28 to be formed into the integrated steering oil pressure generating unit 6. Therefore, as shown in FIG. 2, when the electrically driven assist device 26 is carried through the upper holder 35 and the lower holder 36 on the instrument panel 3, the whole of the steering oil pressure generating unit 6 can be easily carried on the instrument panel 3. Moreover, above the common base 28 there is provided the support space of the electrically driven assist device 26 and the helm pump 27 while under the common base 28 there is provided the arrangement space of the transmission system 34. Thus, the upper and lower spaces of the common base 28 can be partitioned by function, and the transmission system 34 can be efficiently accommodated in the lower space.

While the invention has been described in its preferred form, various modifications and variations of the invention are possible in light of the above teachings. For example, the transmission system may be formed in the chain drive type or belt drive type. In this case, sprockets or pulleys are provided on each of the output shaft 33 and the pump shaft 46, and a chain or endless belt is wrapped around these sprockets or pulleys. With this construction, it is possible to obtain the inexpensive and reliable transmission system. Moreover, since the length of the chain or belt can be relatively easily changed, it is easily possible to change the center distance between the output shaft 33 and the pump shaft 46, so that the freedom of layout with respect to the electrically driven assist device 26 and the helm pump 27 can be enhanced. In addition, it is easy to choose various speed change ratios. Further, a number of idlers can be freely chosen to adjust the length of the chain or belt.

In the case of the gear mechanism, the center distance between the above two shafts can be changed by interposition of the idle gear. Further, by the application of a multiple stage gear train having an intermediate gear, the speed change ratio (speed increasing ratio) can be increased while making the entire system compact. Furthermore, when a planetary gear mechanism is employed as the gear mechanism, the output shaft 33 of the electrically driven assist device 26 is connected to an input side of the planetary gear mechanism and the pump shaft 46 of the helm pump 27 is connected to an output side of the planetary gear mechanism. With this construction, the steering force can be transmitted to the helm pump 27 after being changed in speed. Moreover, the electrically driven assist device 26 and the helm pump 27 can be arranged in series and formed into an integrated unit.

Further, the transmission system in which the speed change ratio is variable can be provided not only in the planetary gear mechanism but also in the conventional gear train mechanism. For example, it is possible to employ the publicly known system in which a constant-mesh gear train is provided and the connection between the gears is changed by a dog clutch. Moreover, in the chain drive or belt drive transmission, there can be employed such a transmission system that the speed change ratio is variable. In the case of the chain drive transmission, sprockets which are different in sizes can be provided in multiple stages. Then, a chain is wrapped around the selected sprockets. In the case of the belt drive transmission, conventional V-belt pulleys are provided, and variable speed transmission can be performed by varying the width of a V-groove. The provision of the transmission system as above allows the speed change ratio to be varied freely, thereby making it possible to vary the transmission rate of the steering force over a wide range. Therefore, it is possible to adjust the transmission rate to obtain the response that one likes, so that the comfortable sailing can be realized.

What is claimed is:

1. A power steering apparatus for a small vessel comprising:

a steering means being arranged on a rear part of a hull to be rotatable in a horizontal direction;

a handle in a cabin;

an electrically driven assist device for adding assist force to steering torque generated through the operation of the handle to output an assisted steering torque;

a pump device generating oil pressure in accordance with the assisted steering torque to hydraulically drive the steering means; and a common base including a front surface, wherein the pump device and the electrically driven assist device are disposed in parallel on the front surface of the common base and formed into an integrated unit such that rotation output power which is outputted from an output shaft functioning as a rotation shaft of the electrically driven assist device is transmitted through a transmission system to a driving shaft of the pump device.

2. The power steering apparatus for the small vessel according to claim 1, wherein the integrated unit is disposed within a space defined under an instrument panel on which the handle is supported, and the electrically driven assist device is carried on the instrument panel.

3. The power steering apparatus for the small vessel according to claim 1, wherein the pump device and the electrically driven assist device are mounted on the common base, while the transmission system is disposed under the common base.

4. The power steering apparatus for the small vessel according to claim 1, wherein the pump device comprises a pump shaft functioning as the rotation shaft to be rotated by driving torque which is transmitted through the transmission system, and the pump shaft is arranged in parallel with the output shaft of the electrically driven assist device.

5. The power steering apparatus for the small vessel according to claim 1, wherein the electrically driven assist device comprises an electric motor, a worm gear being driven by the electric motor, a worm wheel being engaged with the worm gear, and the output shaft being coaxially and integrally combined with the worm wheel, and wherein the electric motor and the pump device are arranged on the right and left of the output shaft.

6. The power steering apparatus for the small vessel according to any one of claims 1 through 5, further comprising a transmission cover for covering a periphery of the transmission system.

7. A power steering apparatus for a small vessel comprising:

a steering means being arranged on a rear part of a hull to be rotatable in a horizontal direction;

a handle in a cabin;

an electrically driven assist device for adding assist force to steering torque generated through the operation of the handle to output an assisted steering torque;

a pump device generating oil pressure in accordance with the assisted steering torque to hydraulically drive the steering means; and a common base including a front surface, wherein the pump device and the electrically driven assist device are disposed in parallel on the front surface of the common base such that rotation output power outputted from an output shaft of the electrically driven assist device is transmitted through a transmission system to a driving shaft of the pump device, wherein the pump device comprises a swash plate type axial piston pump, and wherein the transmission system transmits a rotation output power of the electrically driven assist device at increasing speed to the pump device.

8. The power steering apparatus for the small vessel according to claim 7, wherein the transmission system comprises a gear train.

9. The power steering apparatus for the small vessel according to claim 7, wherein the transmission system comprises a pair of sprockets, and a chain being wrapped around the pair of sprockets to function as a transmission means.

10. The power steering apparatus for the small vessel according to claim 7, wherein the transmission system comprises a pair of pulleys, and an endless belt being wrapped around the pair of sprockets to function as the transmission means.

11. The power steering apparatus for the small vessel according to any one of claims 7 through 10, wherein the transmission system further comprises a speed change mechanism which makes a speed change ratio variable.

12. A power steering apparatus for a small vessel comprising:

a steering means being arranged on a rear part of a hull to be rotatable in a horizontal direction;

a handle in a cabin;

a torque sensor detecting steering torque generated through the operation of the handle;

an electrically driven assist device generating an assist force based on the torque detected by the torque sensor and adding the assist force to the steering torque to output an assisted steering torque;

a pump device generating oil pressure in accordance with the assisted steering torque to hydraulically drive the steering means; and a common base including a front surface, wherein the pump device and the electrically driven assist device are disposed in parallel on the front surface of the common base such that rotation output power outputted from an output shaft of the electrically driven assist device is transmitted through a transmission system to a driving shaft of the pump device, and wherein an input shaft of the electrically driven assist device is connected to a steering shaft of the handle and the torque sensor is arranged around the input shaft such that an impact load in an axial direction which is transmitted from the handle to the input shaft is not directly imposed on a detection element of the torque sensor.

13. The power steering apparatus for the small vessel according to claim 12 wherein the torque sensor magnetically detects torsion between the input shaft and an output shaft of the electrically driven assist device.

14. The power steering apparatus for the small vessel according to claim 12, wherein the torque sensor is arranged through a bearing around the input shaft and fixed to the electrically driven assist device.

15. The power steering apparatus for the small vessel according to any one of claims 12 through 14, wherein the electrically driven assist device is carried through a tubular holder on an instrument panel, and the torque sensor is arranged within the holder.

16. The power steering apparatus for the small vessel according to claim 14, wherein each of the input shaft and the output shaft of the electrically driven assist device extends coaxially and is carried through a bearing on a gear case of the electrically driven assist device, and the bearing of the torque sensor is located above the bearing of the input shaft.

* * * * *